US005869830A

United States Patent [19]

Franzen et al.

[11] Patent Number: 5,869,830

[45] Date of Patent: Feb. 9, 1999

[54] EXACT MASS DETERMINATION WITH MALDI TIME-OF-FLIGHT MASS SPECTROMETERS

[75] Inventors: Jochen Franzen, Bremen; Claus Koster, Lilienthal, both of Germany

[73] Assignee: Bruker-Franzen Analytik GmbH, Bremen, Germany

[21] Appl. No.: 914,695

[22] Filed: Aug. 19, 1997

[51] Int. Cl.[6] ..... H01J 49/40

[52] U.S. Cl. ..... 250/287

[58] Field of Search ..... 250/287, 281, 250/282

[56] References Cited

U.S. PATENT DOCUMENTS

| | | | |
|---|---|---|---|
| 5,504,326 | 4/1996 | Reilly et al. | 250/282 |
| 5,712,479 | 1/1998 | Reilly et al. | 250/287 |

FOREIGN PATENT DOCUMENTS

| | | |
|---|---|---|
| 2308492 | 6/1997 | United Kingdom . |
| 2305539 | 9/1997 | United Kingdom . |
| 9636987 | 11/1996 | WIPO . |

OTHER PUBLICATIONS

Robert S. Brown et al, *Mass Resolution Improvement by Incorporation of Pulsed Ion Extraction in a Matrix–Assisted Laser Desorption/Ionization Linear Time–of–Flight Mass Spectrometer,* Analytical Chemistry, vol. 67, No. 13, Jul. 1, 1995.

*Primary Examiner*—Kiet T. Nguyen

[57] ABSTRACT

A method relates to exact mass determination of analyte ions in time-of-flight mass spectrometers using an ionization of analyte substances on sample supports by matrix-assisted laser desorption (MALDI), and an improvement in mass resolution by time-delayed ion acceleration in the field between the sample support and an intermediate acceleration electrode. It particularly relates to methods for the stabilization of a once calibrated mass scale when there are unwanted changes in the distance of the sample support from the intermediate acceleration electrode.An unknown change of this distance can be compensated for by a coupled change of both total accelerating voltage and partial acceleration voltage between sample support and intermediate electrode in a simple manner by adjusting the time of flight of ions from a reference substance to the value given by the calibrated mass scale. Oligomeric ions from the matrix of the MALDI method serve very well as reference ions. Furthermore, if the range of optimum focus is shifted by a change in the time delay, the calibrated mass scale can be kept valid for all masses through a simultaneous change of the accelerating voltage.

8 Claims, 1 Drawing Sheet

EXACT MASS DETERMINATION WITH MALDI TIME-OF-FLIGHT MASS SPECTROMETERS

The invention relates to exact mass determination of analyte ions in time-of-flight mass spectrometers using an ionization of analyte substances on sample supports by matrix-assisted laser desorption (MALDI), and an improvement in mass resolution by time-delayed ion acceleration in the field between the sample support and an intermediate acceleration electrode. It particularly relates to methods for the stabilization of a once calibrated mass scale when there are unwanted changes in the distance of the sample support from the intermediate acceleration electrode.

An unknown change of this distance can be compensated for by a coupled change of both total accelerating voltage and partial acceleration voltage between sample support and intermediate electrode in a simple manner by adjusting the time of flight of ions from a reference substance to the value given by the calibrated mass scale. Oligomeric ions from the matrix of the MALDI method serve very well as reference ions. Furthermore, if the range of optimum focus is shifted by a change in the time delay, the calibrated mass scale can be kept valid for all masses through a simultaneous change of the accelerating voltage.

PRIOR ART

The exact determination of ion masses is becoming more and more important, especially for macromolecular ions of biogenic materials. Thus the molecular masses of glycoproteins, glycolipids or oligosaccharides alone, for example, provide information about structures as well, since the genesis of biomolecules by prescribed formation mechanisms greatly limits the possibly extremely large structural variety. Mass determination of fragment ions supports and expands these claims. But also in many other biochemical and medical applications, the mass determination of ions from biogenic materials is moving to the foreground.

Among the methods for ionization of macromolecular substances on sample supports, matrix-assisted desorption by a laser flash (MALDI) has found the widest acceptance. After leaving the surface, the ions generally have a substantial average velocity which is the same to a large extent for ions of all masses, and a strong spread around the average velocity. The average velocity leads to a non-linear relationship between the flight time and root of the mass, and therefore the mass scale. The spread leads to bad mass resolution and thus to an uncertainty when measuring the signals of individual ion masses, however there are methods which improve mass resolution.

For ionization by matrix-assisted laser desorption (MALDI), the large analyte molecules are stored on a sample support in or on a layer of low-molecular matrix substance. A laser light pulse of a few nanoseconds duration, focussed onto the sample surface, vaporizes a small amount of the matrix substance in a quasi-explosive process, whereby the analyte molecules are also transferred into the initially tiny vapor cloud.

The vapor cloud expanding into the vacuum not only accelerates the molecules and ions of the matrix substance through its a diabetic expansion, but also the molecules and ions of the analyte substance through viscose entrainment, which thereby receive higher kinetic energies than would correspond to thermal equilibrium. Even without an accelerating field, the ions attain average velocities of about 500 to 1,000 meters per second, dependent upon the energy density of the laser beam; the velocities are to a large extent independent of the mass of the ions, however they have a large spread of velocity which ranges from about 200 up to 2,000 meters per second. It must be assumed that the neutral molecules of the cloud also attain these velocities.

The ions are accelerated in the ion source with electrical fields at energies of around 10 to 30 keV, are shot into the flight path of the mass spectrometer and detected with high time resolution at the end of the flight path. From their flight time, their mass-to-charge ratio can be determined. Since this type of ionization practically supplies only singly charged ions, the term "mass determination " will be used in the following, not the more exact term "determination of the mass-to-charge ratio". Flight times are converted into mass via a calibration curve, the acquisition of this calibration curve being described as "calibration of the mass scale" of the time-of-flight spectrometer. The calibration curve can be stored in table form as a sequence of pairs of mass and flight time values in the memory of the data processing system, or in the form of parameter values for a mathematical function describing the mass relative to the flight time.

During formation of the vapor cloud, a small part of both the matrix and analyte molecules are ionized. During expansion of the vapor cloud, continuous ionization of the larger analyte molecules takes place through further ion-molecule reactions at the cost of the smaller matrix ions.

The large spread of velocities and the formation process of the ions which is smeared over time, limit the mass resolution both in both linear as well as energy-focussing, reflecting time-of-flight mass spectrometers. A spread of initial velocities alone could be focused out using the energy-focussing reflector, however the time-smearing of the formation of the ions cannot.

A method for the improvement of mass resolution under these conditions has been known for some time. The ions of the cloud are first allowed to fly a brief time $\tau$ in a drift region without any electrical acceleration. The faster ions thereby distance themselves further from the sample support electrode than the slow ions, and the distribution of the ions' velocities results in a spatial distribution. Only then the acceleration of the ions is switched on. The acceleration field normally is homogeneous and shows a linearly declining accelerating potential. When the acceleration field is switched on, the faster ions have a wider distance from the sample support electrode and therefore are located at a somewhat reduced accelerating potential. This gives them a somewhat lower final velocity for the drift region of the time-of-flight spectrometer than the initially slower ions. With correct selection of the time lag $\tau$ and potential drop (i.e. the strength of the acceleration field), the initially slower, but after acceleration faster ions catch up again with the initially faster, but after acceleration slower ions exactly at the detector. In this way, ions are dispersed at the location of the detector relative to the mass, but if of equal mass, are focussed in first order relative to the flight time. In this way, a sufficiently high mass resolution is achieved in a linear time-of-flight mass spectrometer. There is a similar method for time-of-flight spectrometers with reflectors, by which even second order focussing is achieved.

Delayed ion acceleration need not be connected to a switching of the entire accelerating voltage U. Switching of such high voltages in extremely short times of a few nanoseconds is still almost unattainable today and associated with high costs. Switching of a partial accelerating voltage V is sufficient, if an intermediate electrode is installed in the acceleration path. Then only the space between the sample support electrode and the intermediate electrode, which have a relatively low distance d from one another, need be field-free at first and then switched over after a delay into an acceleration field with a strength of V/d. The distance d of the sample support to the intermediate electrode should be as small as possible in order to switch the lowest possible voltages V. There is a lower limit of about 1 mm for this distance which is hardly realizable however for practical designs of ion sources. In practice, this distance d is about three millimeters.

The desire for a good mass resolution essentially has the purpose of achieving a good mass determination. However, since introduction of this method, it has been seen that the possibility in principle of good mass determination does not always lead to correct mass determination. The function which describes the mass relative to the time of flight, i.e. the calibrated mass scale, often leads to erroneous mass determinations during MALDI ionization. For an ion with a mass of 5,000 atomic mass units, the result of the mass calculation from scan to scan can fluctuate between several mass units in extreme cases.

It has therefore become customary for exact mass determinations to correct the masses of the analyte ions to be determined by simultaneous measuring the flight time of ions from added known substances (so-called "internal reference substances"). As the simplest method, the mass of the analyte substances was corrected by linear extrapolation based on a relationship between the flight time and the root of the mass assumed to be linear. As reference masses, the known ions of the matrix, particularly their dimeric ion, were taken. This method leads to greatly improved accuracy in mass determination, on the order of magnitude of about 200 ppm. In this way, however, there is still an uncertainty of one mass unit for the ion with a mass of 5,000 u.

Even the method for improvement of mass resolution through delayed acceleration has a decisive disadvantage for exact mass determination: it provides the optimum mass resolution only in a narrow range of the mass scale. In the other mass ranges, resolution is still considerably improved, but not up to its optimum value. This range of optimum resolution may be adjusted to any desired position on the mass scale by changing the time lag $\tau$, to a smaller degree also by changing the partial accelerating voltage V, but if this is done the calibration of the mass scale is thereby lost.

According to DIN, the term "precise" is used for high repeatability, and the term "accurate" for correct determination of mass with an as small as possible deviation between the corrected measurement value and the true value of the mass.

OBJECTIVE OF THE INVENTION

It is the objective of the invention to find an electrical compensation for a changed distance d between sample support and intermediate electrode which keeps valid the calibrated mass scale within narrow error tolerances and, at the same time, retains the optimum focus. It is a further objective of the invention to find a method by which the optimum focus can be adjusted to the analyte ions to be measured, whereby again the once calibrated mass scale should remain valid within narrow error tolerances. It is also the objective of the invention to maintain the validity of the mass scale even with superimposition of the displacement of the focus and compensation for the distance d. It is finally the objective of the invention to find a method by which even changes in the distance d of an unknown size may be compensated.

BRIEF DESCRIPTION OF THE INVENTION

It is a basic idea of the invention to retain the calibration of the mass scale by compensating for an unknown change in the distance d in such a way that both voltages V and U are commonly changed (coupled change), until the flight time of a known reference ion mass takes on exactly the value given by the calibration of the mass scale. If V is changed by the relative amount $p=\Delta V/V$, the total voltage U must then be changed by the relative amount $c_1 \times p \times U$, $c_1$ being an instrument constant which must be determined only once for one type of mass spectrometer.

It is another idea of the invention to retain the calibration of the mass scale during shifts of the optimum mass resolution. If the time delay $\tau$ is changed to shift the point of best mass resolution in the spectrum, the acceleration voltage U has to be changed in a partial linear proportion with an instrumental constant $c_2$. Even both changes can be compensated for in a single correction if a third instrumental constant $C_3$ is introduced.

It is a further idea of the invention to maintain the calibration of the mass scale for large sample support plates by a three-point compensation with further linear interpolation of the compensation control.

Figure 1:
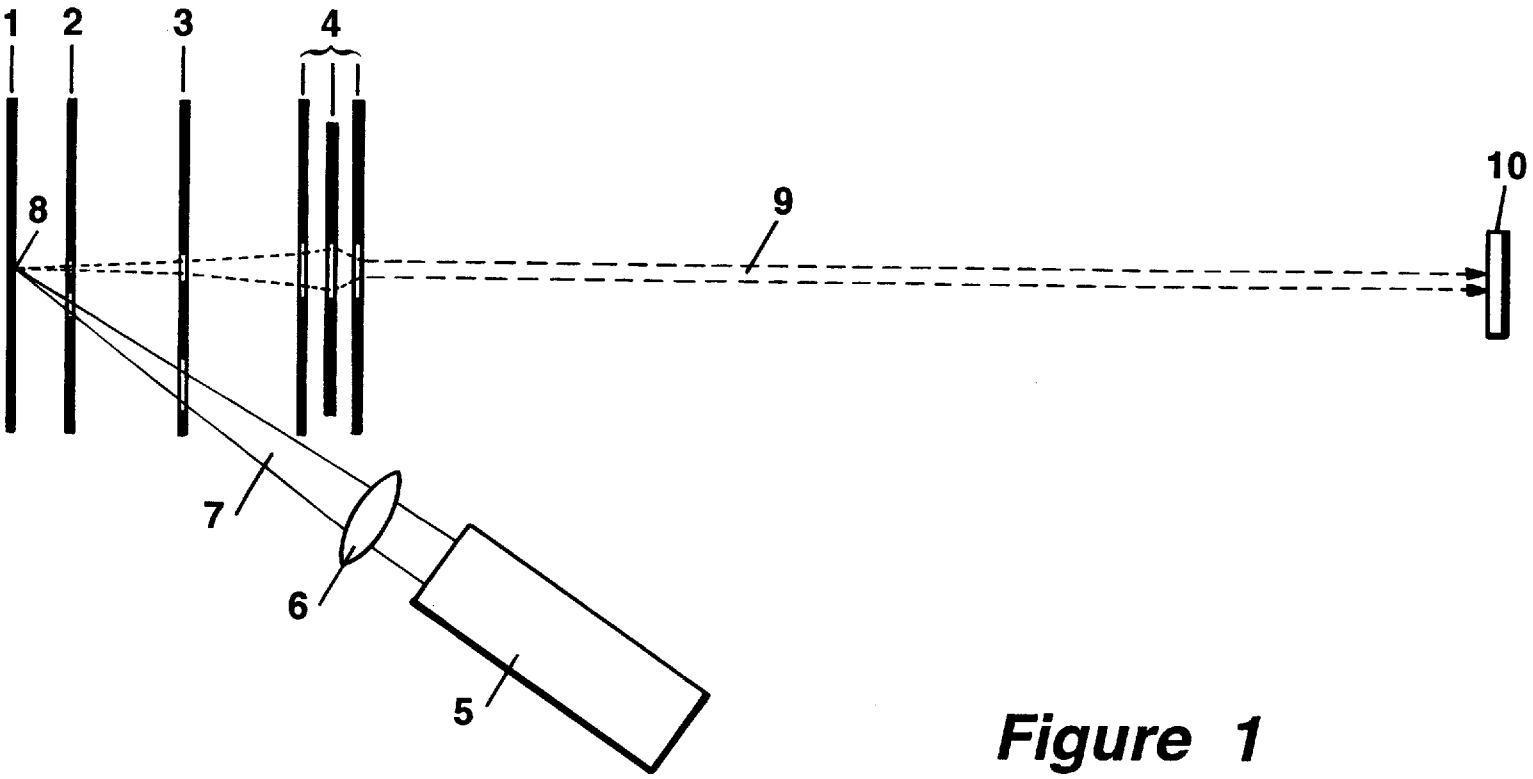
FIG. 1 shows the basic design of a time-of-flight mass spectrometer with the sample support electrode 1 at the accelerating potential U, the intermediate electrode 2 at a switchable potential, the base electrode 3 at ground potential, an ion-optical Einzel lens 4, and the ion detector 10. A light flash from laser 5 is focused from lens 6 in a convergent light beam 7 onto sample 8, which is on sample support 1. At this time, the intermediate electrode is also at the accelerating potential U. The light flash, in a MALDI process, generates ions from the analyte substance with an initial velocity v and a large spread of velocity. After a time lag $\tau$, the intermediate electrode 2 is switched down from potential U to potential U–V, and the ions are accelerated. They form beam 9 of the ion stream which, after passing through the flight path between base electrode 3 and detector 10, is measured by detector 10 with time resolution.

The arrangement shown here has gridless diaphragms as intermediate electrode 2 and base electrode 3 and therefore needs an Einzel lens 4. If grids are added to the intermediate electrode 2 and base electrode 3, Einzel lens 4 is no longer necessary.

Analysis of the Problem

If the ions have no initial velocity, the relationship between the flight time of the ions t and the root of their mass $\sqrt{m}$ is strictly linear. Considering an average initial velocity of the ions, this relationship is however no longer linear, but rather has a weak quadratic term which cannot be neglected. The quadratic term is not eliminated by improvement of the mass resolution by a delayed ion acceleration (also called "delayed extraction").

Through mathematical derivation of this theoretically obtained relationship according to various instrumental or process engineering parameters, we were able to check the criticality of these parameters. We thereby determined that one parameter, which cannot be kept completely constant using instruments, has an enormous influence: namely the distance d of the sample support from the first acceleration diaphragm, i.e. the intermediate electrode. Of lesser influence is the average velocity v of the ions when acceleration starts. All remaining parameters are voltages or geometric dimensions which can be kept very precisely constant.

A change in the distance d by only 100 micrometers alters the results of a mass determination by about 500 ppm, therefore one ion with a mass of 10,000 u is already measured incorrectly by five atomic mass units.

If we introduce the abbreviation for the root of the mass-to-charge ratio $$w=\sqrt{\frac{m}{q}} \tag{1}$$

the the relationship between the flight time t (measured as of switching on of acceleration, i.e. the time $\tau$ later than the ion generation by the laser flash) and the root w thus takes on the following, very simple form, whereby all non-critical parameters are summarized in the reduced flight path l and only the dependencies on the accelerating voltages, the distance d and the average velocity v are reproduced:

$$t=\left(\frac{1}{\sqrt{2\times U}}+\frac{d}{\sqrt{V/2}}\right)\times w-\frac{v\times d}{V}\times w^2, \tag{2}$$

where U is the full accelerating voltage, V the partial accelerating voltage between the sample support and intermediate diaphragm, and l is a reduced flight path which is only dependent upon the geometry of the time-of-flight spectrometer and in which all other geometric dimensions are contained. The partial accelerating voltage Vis switched on after a time lag of $\tau$, to improve the mass resolution. As described above, d is the distance between the sample support and the intermediate diaphragm, and v is the average velocity of the ions when switching on the acceleration. The term with $w^2$ is small compared to the linear term in w, however it attains significant influence with increasing mass.

Our investigations have shown that displacements of the mass scale in regard to the calibration sometimes arise from the fact that the analyte layers on the sample support are of different thicknesses. According to the method most widely used today, the samples are applied in solution, together with dissolved matrix substance, onto the sample support. The goal is to generate small matrix crystals which contain the analyte sample molecules. The growth of these crystals cannot be controlled; sometimes large crystals result, other times small ones. This method is however currently being replaced by methods which produce a layer of uniform thickness.

However, technical problems also lead to the fact that distance d is not always constant and does not always correspond to the value provided during calibration of the mass scale. Modern sample supports should hold thousands of samples, therefore they are designed with a large surface area, and sample supports greater than 100 millimeters in length are the goal. The sample supports are introduced via locks into the vacuum system of the mass spectrometer where they are inserted into a holder which is moved by a movement device. Insertion into the slide rails of the holder with spring action positioning does not always occur as precisely as necessary due to the vacuum conditions. Narrow tolerances for the slide rails and lubricants cannot be applied in a vacuum. Parallel displacement of this sample support by more than 100 millimeters for the scanning of different samples can easily cause a change in the distance d to the intermediate electrode on the order of magnitude of several tenths of a millimeter. With a change of this distance d by only 100 micrometers, the flight time of the ions is already changed to such degree that the signal of an ion with a mass of 5,000 u appears displaced by more than two atomic mass units on the mass scale.

Up to now it has not been possible to find an electrical compensation for a varying distance d to reconstruct the once calibrated relationship between the flight time and mass (i.e. the mass scale) through purely electrical adjustment for all masses. From the equation (2), the existence of such electrical compensation of good accuracy cannot be seen since a change in the distance d must be compensated in the linear term via $\sqrt{V}$, whereas in the quadratic term it must be compensated via V.

In the case of delayed start of acceleration, it is additionally true that a change to V, done in such a way that best mass resolution results, does not also simultaneously restore the flight times of the ions. This restoration of the best resolution must return the acceleration field, i.e. the relation V/d, to its predetermined value.

DETAILED DESCRIPTION OF THE INVENTION

Surprisingly, it has been shown in experiments that electrical compensation for the change in the distance d is indeed possible in contrast to the impression given by equation (2). An experimentally introduced change in distance d of 10% was already compensated for in the first approximation by a change just in the partial accelerating voltage V between the sample support and intermediate electrode (at a constant total accelerating voltage U), so that the calibrated mass scale became valid once again with a maximum error of about 30 ppm of mass over a wide mass range of 500 u to 2,500 u. However, the voltage V had to be changed by more than just 10%, an overcompensation of about 14% was necessary. At the same time however, degradation of the resolution, i.e. the sharpness of the mass signals, occurs.

Degradation of the resolution can however be avoided if, through a change in the partial accelerating voltage V which essentially restores only the field strength in the first acceleration path between the sample support and intermediate electrode, and through a further compensation of the distance change by the total accelerating voltage U. V is therefore changed in proportion to the change in distance d, and the remainder of the compensation is effected by a change in the voltage U. Surprisingly, the mass scale is retained over the entire calibrated mass range with good accuracy through this coupled change in both accelerating voltages U and V.

It is surprising that the accelerating voltage U must also be changed linearly to the change of d, however not completely proportionally, but rather only linearly proportional at a small fraction. For a time-of-flight mass spectrometer with a distance d=3 millimeters, a second acceleration path of 30 millimeters, and a flight path of 1.6 meters, this fraction $c_1$ amounts to about 1/130. Therefore, if d is changed by 10%, V must also be changed by 10%, however the accelerating voltage U is only changed by 0.075%. The mass scale is then valid once again in a very large mass range of 500 to 10,000 atomic mass units, with a maximum error of 1 ppm of flight time or 2 ppm of the mass. These results exceed the measurement accuracy achieved experimentally and were gathered through computer simulations, however they were also verified on the time-of-flight spectrometer within the scope of measurement accuracy available there of about 10 ppm.

If the distance d therefore changed by a relative amount $\Delta d/d$, the accelerating voltage V must also be changed by, this amount $V\times\Delta d/d$, the total accelerating voltage on the other hand by the amount $c_1\times U\times\Delta d/d$ whereby the fraction $c_1=0.0075$ applies for the type of time-of-flight spectrometer described above. For types of mass spectrometers which are geometrically different, similar results can be achieved with different values for the constant $c_1$.

If we introduce the index c for the parameters used during the calibration of the mass scale, and the index s for the parameter values changed through the control, and if we use the abbreviation $$p=\Delta V/V=(V_s-V_c)/V_c=(d_s-d_c)/d_c \quad (3)$$

then the following equations apply:

$$V_s=V_c\times(1+p) \text{ and} \quad (4)$$

$$U_s=U_c\times(1+c_1\times\Delta V/V)=U_c\times(1+c_1\times p)=U_c+U_c\times c_1\times p. \quad (5)$$

It is therefore a basic idea of the invention to compensate for a change in the distance d by a coupled change in the accelerating voltages U and V in such a way that the calibration of mass scale is retained. An unknown change in the distance d can be compensated by a variation of p until the flight time of a known reference ion takes on exactly the value calibrated for it. If V is changed by the relative amount $p=\Delta V/V$, U must then be changed by the relative amount $c_1\times\Delta V/V\times U=c_1\times p\times U$, $c_1$ being an instrument constant which must be determined only once for one type of mass spectrometer.

From this a control system may be constructed which influences the parameter p via measurement of the flight time t of a reference ion mass and a comparison with the correct value for this flight time long enough until the measured flight time t takes on the correct set value. As already described above, it has been found through computer simulations (and also experimentally within the scope of accuracy) that the mass scale is then valid over a very large range, for example for the range from 500 u to 10,000 u with a maximum error below 2 pate per million (ppm) of the mass m (1 ppm of the flight time t). Even at a mass of 10,000 u, the mass could still be determined exactly to within 0.02 u if the measuring accuracy would allow it. At the same time, the adjusted resolution remains optimal.

The value of the parameter p can be calculated in a first approximation, with the help of equations (1) to (5) and with a reasonable assumption for the average start velocity v, from the deviation of the flight time of the reference ions.

For these measurements, the flight time t for small ions must be determined exactly to within about two hundredths of a nanosecond, which is not yet entirely possible today. The centroid of the line profile is normally used for the measurements. The line profile is scanned according to current technology using a transient recorder with 1 or 2 gigahertz. Transient recorders with a 4 gigahertz scanning rate are in the introductory phase. Generally, the measurements from several measurement cycles are cumulated before the centroid is created.

The method for improvement of the mass resolution through delayed start of acceleration provides, as already mentioned above, the optimum mass resolution only in a narrow range in the mass scale. In the other mass ranges, the resolution is still considerably improved, however not to its optimum value. The optimum resolution can particularly be adjusted to any desired ion mass through changes in the time lag $\tau$ (but also through the accelerating voltages U and V).

If the mass of the reference ions is much smaller than that of the analyte ions, as for example when the always present matrix ions are used as reference ions, a special method for improvement of the mass accuracy can be applied: one can temporarily shift the range of optimum resolution to the range of the light reference ion masses by changing the time lag $\tau$, and then adjust the distance d using the flight time of these light reference ions. An extremely good focussing results for light ions. The width of the mass signal amounts to only one or two nanoseconds for light ions of about 500 atomic mass units, therefore it is possible to make a very precise adjustment here. The flight time t of the reference ions must be adjusted in this case to a value which corresponds to a different calibration curve for the mass scale with this adjusted focus range. After shifting the optimum focus range back to the analyte ions whose mass is to be measured, the mass of these analyte ions can then be correctly measured since the change in the distance d has been compensated for by changes in the accelerating voltages.

For this, it is not even necessary to have calibrated the entire mass scale for the case of adjusted focus range; it is sufficient to know the value of the correct flight time $t_c$ for the matrix ions. If only a small number of different matrix ions are used, their flight times $t_c$ can easily be measured and stored at the same time using the calibration of the mass scale. The voltages can be set so precisely nowadays that voltage inaccuracies are unimportant.

If, however, reference ions should be used which are different from sample to sample, this method is not applicable since their flight times must be measured at the same time as the one-time calibration of the mass scale. It is therefore a further surprising finding of our experiments that the range of optimum resolution can be shifted in such a way that the calibrated mass scale remains valid within very narrow margins of error. In this way, the optimum focus range for the light reference masses can be shifted in such a way that the flight time t can be adjusted for that set value which is prescribed by the calibrated mass scale for these reference ions.

If the mass scale is to remain valid, the range of optimum focus can therefore not be adjusted by a change in voltages alone. This always leads to a tipping of the mass scale and cannot be corrected electrically. It is necessary to adjust the focus range via the time lag $\tau$. By changing $\tau$ alone, the mass scale moves slightly, however this movement can be compensated for by a slight co-control of the total accelerating voltage U. Surprisingly, the accelerating voltage can be changed again linearly in a simple manner with $\tau$. If $\tau$ is changed by the relative amount $\Delta\tau/\tau$, the accelerating voltage U must be changed by the factor $(1+c_2\times\Delta\tau/\tau)$. Using the example of the above given mass spectrometer, $c_2=0.00299$.

This constant $c_2$ can also be determined once and re-used again and again. If now analog to above, the abbreviation $$q=\Delta\tau/\tau=(\tau_s-\tau_c)/\tau_c \quad (6)$$

is introduced, the accelerating voltage must be controlled as follows:

$$U_s=U_c\times(1+C_2\times\Delta\tau/\tau)=U_c\times(1+c_2\times q)=U_c+U_c\times C_2\times q. \quad (7)$$

In this way a control can be designed which places the range of optimum focus at any desired position on the mass range, without allowing the calibrated mass scale to become invalid. The relationship between q and the mass where the optimum focus lies, can easily be determined experimentally and stored in a control table. It can again be shown through computer simulations (and also experimentally within the scope of measurement accuracy present there), that the mass scale remains valid over a very large range, for example for the range from 500 u to 10,000 u with a maximum error of below 2 ppm of mass (1 ppm of flight time). Even for a mass of 10,000 u, the mass could still be determined exactly to within 0.02 u if the measuring accuracy would allow it.

For superimposed adjustments in the distance and the focus range, a further element p×q with a new constant $C_3$ is added for optimum maintenance of the mass scale:

$$U_s=U_c+U_c\times C_1\times p+U_c\times C_2\times q+U_c\times c_3\times p\times q= \quad (8)$$

$$=U_c+U_c\times C_1\times(V_s-V_c)/V_c+U_c\times C_2\times(\tau_s-\tau_c)/\tau_c+U_c\times C_3\times(V_s-V_c)/V_c\times(\tau_s-\tau_c)/\tau_c$$

For the above described time-of-flight mass spectrometer, $c_1$=0.0075, $c_2$=0.00299 and $C_3$ =0.00015.

With a control according to equation (8) the mass scale remains exact up to a maximum error of flight times of about 2 ppm, of mass determination of 4 ppm. In this way, an ion with a mass of 10,000 u can still be measured exactly to 0.04 atomic mass units with an incorrectly adjusted distance of d =3.30 millimeters, even though, for example, the mass scale was calibrated at an optimum focus for the mass 1,000 u and at a distance of d =3.00 millimeters. Equation (8) includes the above given equations (5) and (7), and is therefore a comprehensive equation for the co-control of $U_s$ according to this invention.

The compensation described by equation (8) can be further improved by the addition of quadratic terms $p^2$ and $q^2$ (with the constants $C_4$ and $c_5$), though this improvement is hardly necessary in the scope of tasks proposed here. The precision of flight time determination from the ion current signal, which is dependent on the number of ions measured, does not normally attain the above given accuracies of mass determination and therefore creates a stronger limitation than the remaining impression of the equation (8). Complete utilization of the accuracy given by the equation (8) already requires the accelerating voltage $U_s$ to be set with a digital-to-analog converter with 20 bit control accuracy.

In the case of lighter reference ions, for example when using the dimeric or trimeric matrix ions, the focus can therefore first be relocated to these ions by means of parameters q (under co-control of $U_s$ according to equation (8)), without allowing the mass scale to become invalid. Using these ions, a possible change in distance is compensated for electrically by the control parameter p (under co-control of $U_s$), until the flight time of the light reference ions is at the value of the calibration. Then the range of optimum focus is shifted back to the analyte ions by means of the parameter q (under co-control of $U_s$), whereby the control parameter p is maintained. The masses of the analyte ions can now be measured very exactly with a scan.

For sample supports with a small sample support surface, only one single control process is normally required, since the parallelism of the sample surface to the intermediate electrode is generally guaranteed sufficiently well by the mounting.

For MALDI sample substances of varying thicknesses, there must be a compensation for the distance for every measurement of a sample. To do this it is necessary to always be able to measure ions of a reference sample at the same time as measurement of the analyte ions. In many cases, ions of the matrix can be used for this, for example the frequently occurring dimeric or trimeric ions of the matrix substance. For this, the above described special method with an adjustment of the focal range can be used. In other cases, an appropriate reference substance must be added to the analyte substance.

The goal of automatic measurement of thousands of samples makes ever larger sample supports necessary. These can certainly be created so flat that the effects which deviations in flatness have on the distance of the sample support may be disregarded. The samples may also be applied very uniformly thin, and also in this way hardly any deviations result. But exact positioning of the distance inside the vacuum system is difficult since neither lubricating greases nor very narrow sliding tolerances can be used. When introducing the sample support into the holder and during parallel movement of the sample support, changes in the distance from the intermediate electrode occur very easily and these must be readjusted according to this invention.

This invention provides a particular advantage here since the change in control parameter p is directly proportional to the change in the distance d. So if the electrical compensation by parameter p is known at some positions on the sample support, the optimum values of p can be linearly interpolated at other positions on the sample support.

For these large sample supports, at least three reference samples are necessary which should be applied as far from one another as possible on the edge of the sample support. Once the distances d at the large sample support plate are compensated on three positions by determination of the control parameter values p, the samples from all remaining positions can automatically be measured by interpolating p from the position in the known manner.

If the analyte substance is unevenly thick, or if a wavy matrix film is stuck onto the sample support, electrical compensation is necessary for each individual sample. For this, a simultaneous reference measurement is again always necessary.

It is a further particular advantage of the invention that electrical compensation for the distance d also restores the second order focussing in a time-of-flight spectrometer with reflector.

Particularly Favorable Embodiments

The method presented here for precise mass determination according to this invention is based upon a linear time-of-flight mass spectrometer, as shown in FIG. 1. The method for co-control of $U_s$ according to equation (8) is however also utilizable with other values for the constants c, $c_2$ and $C_3$, for time-of-flight spectrometers with energy-focussing reflectors.

When using delayed acceleration as described above, the intermediate electrode 2 is initially at potential U of the sample support 1, and is switched down after a time lag τ of several tens to hundreds of nanoseconds to the potential U–V. An operation is also possible in which both the sample support and intermediate diaphragm are at the potential U–V, whereby sample support 1 is raised to potential U after time lag τ.

With this arrangement for a time-of-flight mass spectrometer, spectra of analyte substances can be scanned as usual. Scanning begins with ionization of the analyte substances 8 on the sample support 1, as in the MALDI method of ionization described here. The ions are generated by a light flash of about 3 to 5 nanoseconds duration from laser 5. Usually, UV light with a wavelength of 337 nanometers is used from a moderately priced nitrogen laser. The light flash is focussed through lens 6 as convergent light beam 7 onto the sample 8 on the surface of the sample support 1. The ions formed in the vapor cloud, which is generated by the laser focus, are accelerated, after the time lag τ, first in the electrical field between sample support 1 and intermediate electrode 2, and then in the electrical field between intermediate electrode 2 and base electrode 3. The ion beam slightly defocussed in the electrode arrangement is focussed onto the detector 10 at the beginning of the flight path in the Einzel lens 4. The flying ions form a strongly time variable ion current 9, which is measured at the end of the flight path by ion detector 10 with high temporal resolution.

The time variable ion current provided by the ion beam is usually measured and digitalized at the detector with a scanning rate of 1 or 2 gigahertz. Transient recorders with even higher temporal resolution will soon be available. Usually, the concurrent measuring values from several scans are cumulated before—by means of data evaluation—the mass lines in the stored data are sought and transformed from the time scale into mass values via the mass calibration curve.

The polarity of the high voltage used for the ion acceleration must be the same as the polarity of the ions being analyzed: positive ions are repelled and accelerated by a positively charged sample support, negative ions by a negatively charged sample support.

Of course, the time-of-flight mass spectrometer can also be operated in such a way that the flight path is in a tube (not shown in FIG. 1), which is at accelerating potential -U, while the sample support 1 is at base potential. In this special case, the flight tube is at a positive potential if negatively charged ions are to be analyzed, and vice versa. This operation simplifies the design of the ion source, since the isolators for the holder of the exchangeable sample support 1 are no longer necessary. However, there are disadvantages in other respects.

There are two types of problems which have occurred up to now in precise and exact mass determination using the MALDI ionization method:

(a) During calibration of the mass scale, the range of optimum focus must be set permanently at an arbitrary mass. This may however be very different from the analyte mass which must later be measured and which is unknown during the calibration. In this way conditions for the mass determination are not ideal due to the poor resolution.

(b) Through the technique of exchangeable sample supports, which must be brought through a lock into the vacuum and held there, a constancy of the distance d to the intermediate diaphragm is not guaranteed with the tolerance of less than 10 micrometers necessary for a precise mass determination. This problem becomes more acute if large surface sample supports are used which must be moved on two coordinates parallel to the surface of the sample support. Through changing distances d, no reproducible mass determination is possible.

Both of these problems are solved by this invention.

The focus range can be adjusted by control of the time lag $\tau_s$ as desired, whereby the mass scale remains valid if the accelerating voltage $U_s$ is also adjusted in accordance with equation (8). A change in the distance d can be compensated for by control of the partial accelerating voltage $V_s$ while retaining the focus range, whereby the mass scale remains valid if the accelerating voltage $U_s$ is also adjusted according to equation (8). An unknown change in the distance d can be compensated by bringing the flight time of a reference ion mass back to the value valid for the calibration through coupled control of $V_s$ and $U_s$ according to equation (8).

Calibration of the mass scale can also benefit from the invention. Calibration is normally undertaken using a carefully produced mixture of calibration substances. This mixture contains a number of substances, the ion masses of which fully cover the mass range to be calibrated. Therefore very small as well as very large molecular weights must be present in the mixture. This mixture is ionized in a MALDI process and the flight times of the individual ions are measured as precisely as possible. From the flight times and the corresponding, known masses, the calibration curve for the masses (the "mass scale") is put together. In order to determine the individual flight times as precisely as possible, the optimum focus according to this invention can now be adjusted to the individual calibration masses by control of the time lag $\tau_s$ under co-control of the accelerating voltage $U_s$ according to equation (8). In this way the mass scale can now be calibrated more precisely.

If a mass to be measured is placed exactly in the center of the focus range, the mass signal is thus often slightly asymmetrical. This is because both the faster as well as the slower ions than those of the average velocity v branch off on the same side of the mass line. Through slight shifting of the optimal focus range, the mass line can be made symmetrical to a large extent without at first noticeably changing the line width. In this way, measurement of the exact mass is simplified, which can then be done using a centroid, for example.

The method of this invention also aims at arriving at more reproducible flight times of the ions. As described above, the lack of reproducibility is due to changes in the distance d of the exchangeable sample support from the intermediate diaphragm. This distance can be measured in principle and changes compensated for with a coupled control of U and V according to this invention. Direct measurement of the distance d would however require additional installation of very precise measurement systems in the ion source of the time-of-flight spectrometer. These installations are however in principle unnecessary, since a compensation of unknown distances is possible according to this invention.

This method consists of first checking the distance d before a mass determination of analyte ions using the measurement of flight times of a reference mass and, if necessary, to compensate with a coupled control of U and V according to this invention. To do this, the flight time of the reference ions is measured in a first sample measurement and compared with the correct flight time during calibration. If there is a deviation, the distance d must be electrically compensated. The compensation can be calculated from the above given equations. For very exact measurements, a repetition of the reference measurement with a second electrical compensation is appropriate.

The parameter p can in principle be calculated if a suitable value for the initial average velocity v can be assumed:

$$p = \Delta t/(d_c \times (\sqrt{2m/Vq} - vm/Vq), \tag{9}$$

with $\Delta t$ being the flight time difference $t_s - t_c$ of the reference ions, m and q mass and charge of the reference ions, $d_c$ the correct distance during calibration, and v the initial average velocity of the ions at the start of the acceleration. However, because the initial average velocity v is essentially unknown, a cyclic approximation method should be applied.

It is convenient when testing the distance d to use the ions of the matrix since no special reference substance then needs to be added. It has become apparent that monomer ions are not well suited due to their much too high intensity and the resulting overloading of the measurement device. Furthermore their mass is so far down on the bottom margin of the usable mass range that extrapolation into the desired mass range is unfavorable. In most spectra however, there are dimeric ions in the correct intensity range, sometimes even trimeric or even oligomeric ions. These lines are very sharp and more suitable due to their higher mass. The masses of these ions are still very small however compared to heavy analyte ions. They are generally in the mass range of 300 u to 800 u. It is therefore appropriate to use the above mentioned method for adjustment of the optimum focus range.

For large, although flat, sample supports which can hold thousands of samples, it is practical to test the distance at several, or at least three positions, before the analyte samples are measured. The reference samples for the distance test must be applied as closely to the margin as possible. With the knowledge of the three control parameter values p to compensate for the distance changes, the control values for all other sample positions can then be calculated using linear interpolation. This method however requires that the sample cannot wobble in its holder, but rather be moved reproducibly by the movement device.

For automatic mass determination of thousands of samples, the nature of the analytical problem is often such that the only question to answer is whether the sample has a previously known molecular weight or not. The expected molecular weight can thereby be very different from sample to sample. For this type of task, this invention can be very helpful since the range of optimum focus for every sample can be adjusted to the expected value being tested.

The considerations discussed here for linear mass spectrometers also apply, as any specialist can appreciate, to time-of-flight mass spectrometers with energy-focussing reflectors. Here the reflector voltages must be co-controlled in the same manner as the accelerating voltages U. For this type of mass spectrometer, different apparatus constants $c_1$, $c_2$ and $C_3$ then apply.

The method of precise mass determination given here with a time-of-flight spectrometer according to this invention can of course be varied in many ways. The specialist in development of mass spectrometers and their measurement methods can easily realize these variations.

We claim:

1. Method for the accurate mass determination of analyte ions in a time-of-flight mass spectrometer using a once calibrated mass scale, with ionization of substances on a sample support by matrix-assisted laser desorption (MALDI) and with improvement of the mass resolution in the time-of-flight spectrometer by delayed ion acceleration in a first acceleration region of distance d between the sample support and an intermediate electrode, comprising the steps of (a) applying analyte and reference samples and corresponding matrix substances on a sample support plate, (b) transferring the sample support plate to an ion source inside a vacuum, (c) directing a laser light flash to a reference sample, (d) waiting for a delay time $\tau$ used during calibration, and switching on the acceleration field between said sample support plate and said intermediate acceleration electrode, thereby accelerating the ions towards a flight tube, (e) measuring the flight time of the reference substance ions and comparing the flight time with the correct flight time during calibration, (f) determining a value for a compensation control parameter p and correcting a partial accelerating voltage $V_s$ between said sample support plate and said intermediate electrode and a total acceleration voltage $U_s$ according to equations $V_s=V_c\times(1+p)$ and $U_s=U_c\times(1+c_1\times p)$, wherein $V_c$ is a partial accelerating voltage, $U_c$ is a total accelerating voltage and $C_1$ is an apparatus constant, (g) if necessary, repeating steps (c) to (e) with changed values of parameter p until, by a correct parameter p, the reference ions show the calibrated flight time, and (h) determine the correct masses of analyte ions by corresponding steps (c) to (e) using analyte ions, the correct parameter p and the once calibrated mass scale.

2. Method according to claim 1, wherein said parameter p is calculated, in step (f), by the equation $p=\Delta t/(d_c\times(\sqrt{2m/Vq}-vm/Vq)$, where $\Delta t$ is the flight time difference for the reference ions between actual measurement and calibration, $d_c$ is the correct distance during calibration m and q are mass and charge of the reference ions, V is the partial acceleration voltage, and v is an assumed value for the initial average velocity of the ions.

3. Method according to claim 2, wherein the ions to be measured for their exact masses or the ions used as a reference are each adjusted, by change of the time delay $\tau$, to optimum mass resolution obtained by delayed acceleration.

4. Method according to claim 1, wherein the influence of an additional change of the time delay lay $\tau_s=\tau_c\times(1+q)$ on the mass scale is compensated for by the total accelerating voltage $U_s$ according to the equation $U_s=U_c\times(1+c_1\times p+C_2\times q+c_3\times p\times q)$, whereby $U_c$ and $V_c$ are the total and partial accelerating voltages provided by calibration of the mass scale, $\tau_c$ is the time delay used for the calibration, and $c_1$, $c_2$ and $c_3$ are three apparatus constants.

5. Method according to claim 4, wherein the apparatus constants are in the ranges $0.04\geqq c_1\geqq 0.004\geqq c_1\geqq 0$ and $0.001\geqq c_3\geqq 0$.

6. Method according to claim 5, wherein the constants $c_1$, $c_2$ and $c_3$ are determined by a one time calibration of a mass spectrometer.

7. Method according to claim 1, wherein the monomeric, dimeric or oligomeric ions of the MALDI matrix substance are used as reference ions.

8. Method according to claim 1 using a large-surface sample support, wherein (i) samples of reference substances are applied on at least three locations on the sample support, j) the flight time of each of these reference substances is used for a determination of the compensating control parameter value p at this location, and (k) for the remaining samples on the sample support, linear interpolations of the control parameter p are used according to the two-dimensional coordinates of the sample.

* * * * *